United States Patent [19]

Fisher et al.

[11] 4,363,480

[45] Dec. 14, 1982

[54] EXERCISE DEVICE

[75] Inventors: Milton W. Fisher, Blue Springs; Glen E. Henson, Independence, both of Mo.

[73] Assignee: MGI Strength/Fitness, Inc., Independence, Mo.

[21] Appl. No.: 192,609

[22] Filed: Sep. 30, 1980

[51] Int. Cl.[3] ..... A63B 23/06

[52] U.S. Cl. ..... 272/69; 73/379; 188/187; 272/125; 272/132; 272/DIG. 5

[58] Field of Search ..... 272/69, 73, 93, 72, 272/116 R, 125, 126, 127, 128, 131, 132, 134, DIG. 3, DIG. 4, DIG. 5, DIG. 6; 73/379, 380, 381, 9, 125, 126, 130, 493, 494, 533, 535, 536, 537; 188/187

[56] References Cited

U.S. PATENT DOCUMENTS

| | | | |
|---|---|---|---|
| 299,511 | 6/1884 | Blessing | 272/69 UX |
| 987,644 | 3/1911 | Onken | 73/493 X |
| 1,016,729 | 2/1912 | Barrett | 272/69 |
| 2,199,955 | 5/1940 | Kruck | 73/381 |
| 3,192,772 | 7/1965 | Tarter | 272/73 X |
| 3,432,164 | 3/1969 | Deeks | 272/73 |
| 3,511,500 | 5/1970 | Dunn | 272/126 |
| 3,640,530 | 2/1972 | Henson et al. | 272/125 X |
| 3,643,943 | 2/1972 | Erwin, Jr. et al. | 272/69 |
| 4,151,988 | 5/1979 | Nabinger | 272/69 |

FOREIGN PATENT DOCUMENTS

| | | | |
|---|---|---|---|
| 739835 | 10/1943 | Fed. Rep. of Germany | 188/187 |
| 35776 | 3/1966 | Finland | 73/125 |
| 1565616 | 3/1969 | France | 272/69 |

*Primary Examiner*—Richard C. Pinkham
*Assistant Examiner*—Arnold W. Kramer
*Attorney, Agent, or Firm*—Kokjer, Kircher, Bradley, Wharton, Bowman & Johnson

[57] ABSTRACT

An isokinetic resistance exerciser in the form of a treadmill is the subject of the present invention. An improved isokinetic resistance is provided by oversized frictional members and flat centrifugal plates which respond to centrifugal forces to cause inter-engagement of the frictional surfaces. The invention also includes a centrifugally-responsive speed register mechanism and a device for recording the total work expended by a person exercising. The centrifugally-responsive actuating mechanism employing flat plates in place of conventional weights results in improved operating characteristics.

12 Claims, 10 Drawing Figures

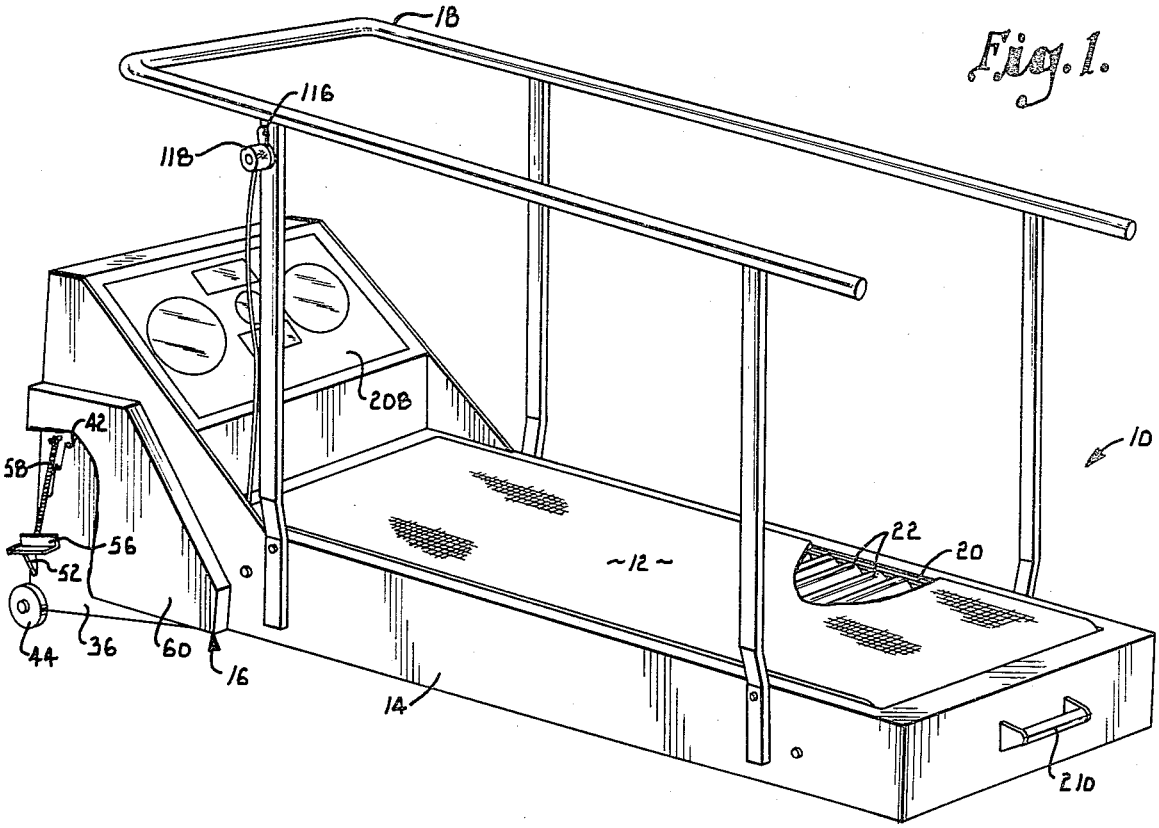
Fig. 1.
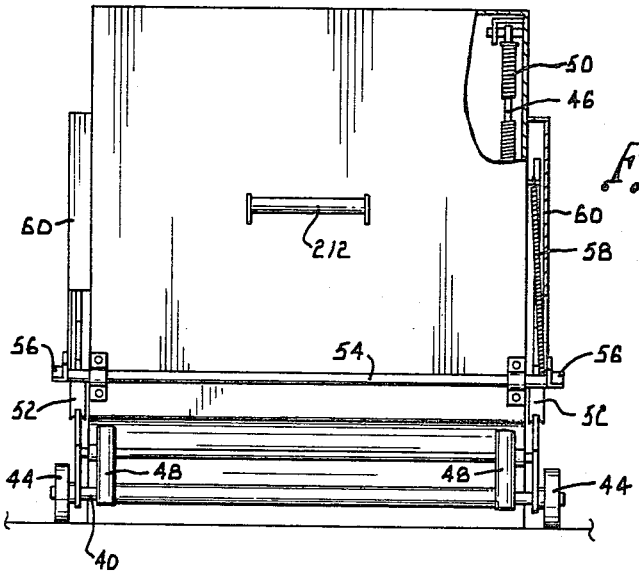
Fig. 3.
Fig. 2.
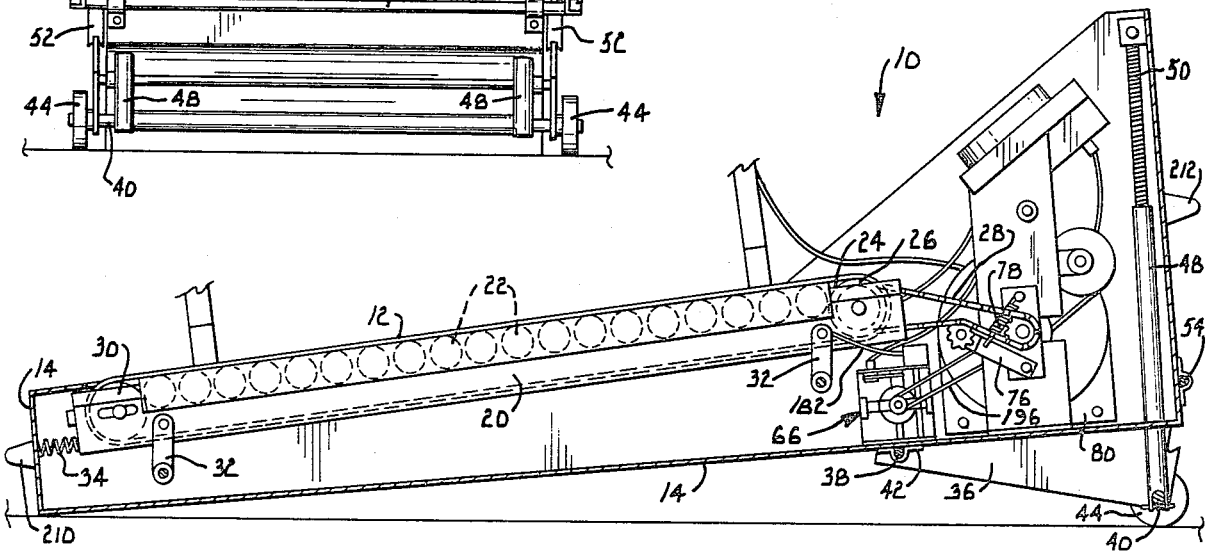

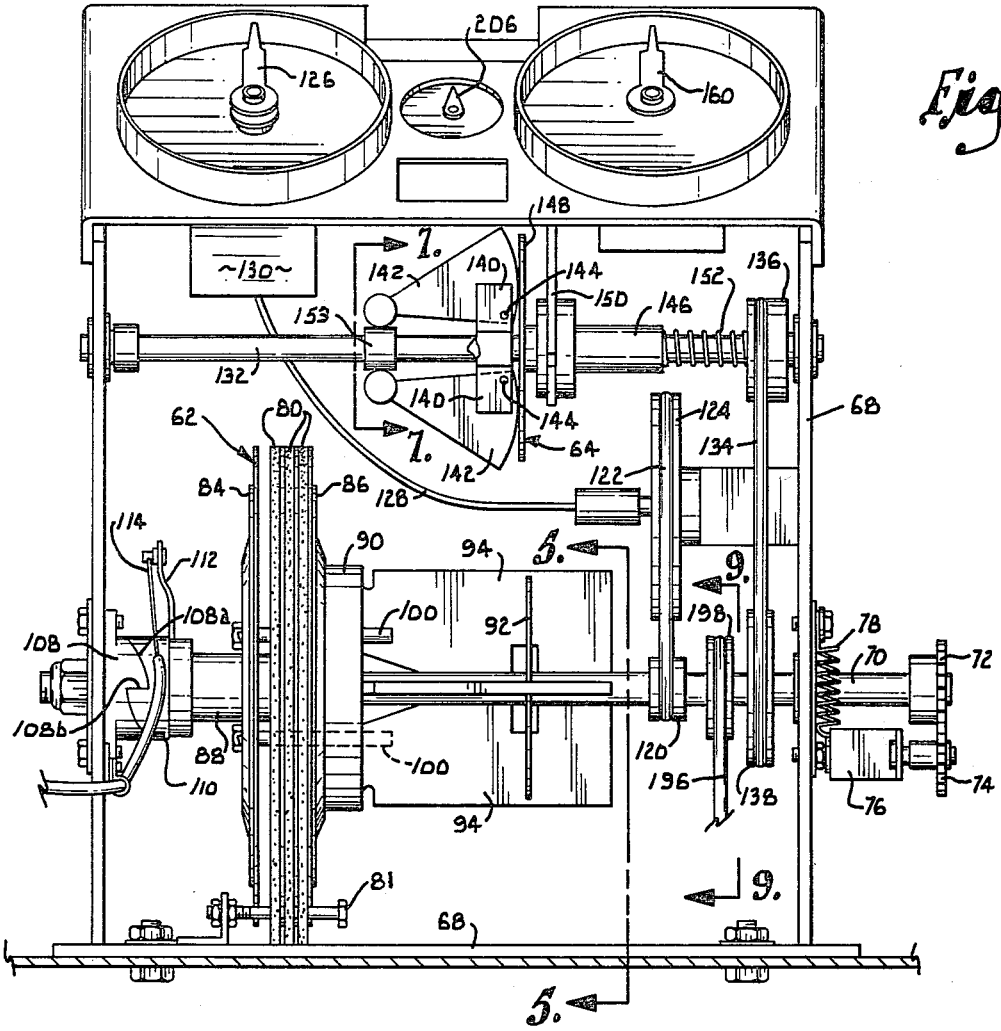
Fig. 4.
Fig. 5.
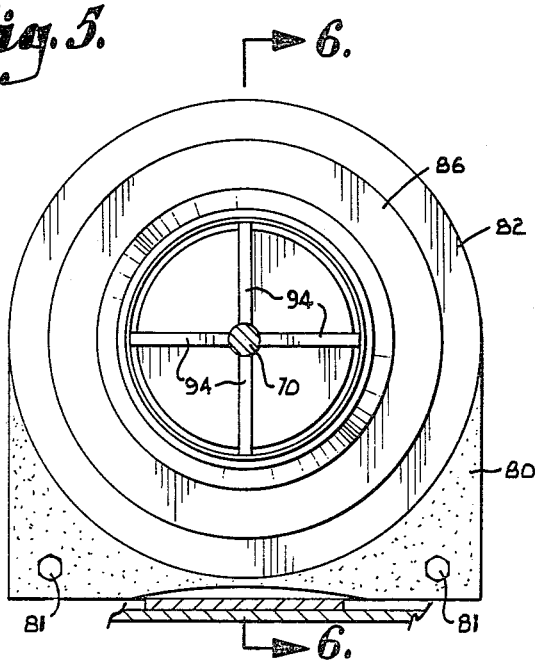
Fig. 7.
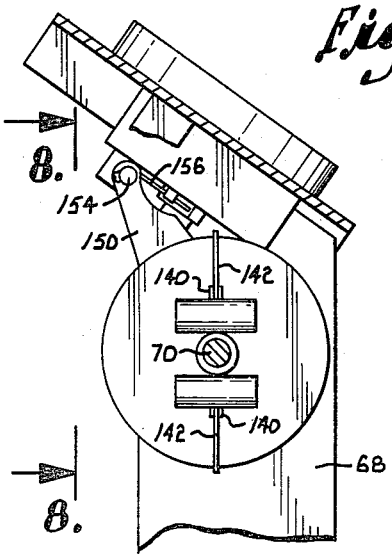

EXERCISE DEVICE

This invention relates generally to exercise apparatus and, more particularly, to exercise apparatus employing an isokinetic resistence.

The advantages of isokinetic resistence exercisers have been known for a number of years. Several types of isokinetic exercising devices are disclosed in prior U.S. Pat. Nos. 3,640,530; 3,896,672 and 4,041,760; all of which are incorporated herein by reference. The present invention relates to numerous improvements in the basic exercise apparatus disclosed in the foregoing patents. Particularly, the present application relates to a treadmill employing an isokinetic resistence and other improvements which are applicable to both the treadmill and other forms of exercisers.

It is therefore a primary object of the present invention to provide a completely mechanical isokinetic resistance treadmill.

As a corollary to the above object, an important aim of the invention is to provide an isokinetic resistance for exercise treadmills which is smooth in operation and provides for sufficient momentum to maintain exercise movement even when the effort exerted by the exerciser is minimal.

An important objective of the invention is to provide an exercise treadmill having a variable height adjustment which can be operated by one person.

Another important aim of the invention is to provide an isokinetic resistance exerciser wherein the speed of the exercise movement can be varied at any time through movement of a simple lever mechanism.

As a corollary to the above aim, an object of the invention is to provide a variable speed isokinetic resistance exerciser wherein the speed may be varied at any time through movement of a lever disposed at a remote location from the resistance mechanism.

Still another object of the invention is to provide an isokinetic resistance exerciser which utilizes flat plates instead of conventional weights as a centrifugal force responsive component thereby providing for greater sensitivity and smoother operation.

An object of the invention is to provide an isokinetic resistance exerciser employing a frictional resistance mechanism wherein the frictional surfaces in interengagement are oversized thereby resulting in better resistance to the forces applied by the user of the device.

An object of the invention is also to provide an apparatus for measuring the speed of exercise movement through the use of centrifugal force responsive means.

An important objective of the invention is also to provide an isokinetic exercise device that measures the total work expended.

Other objects of the invention will be made clear or become apparent from the following description and claims when read in light of the accompanying drawings wherein:

FIG. 1 is a perspective view of the exercise treadmill according to the present invention, with portions broken away for purposes of illustration;

FIG. 2 is a vertical cross-sectional view of the device shown in FIG. 1 to illustrate details of construction;

FIG. 3 is a front elevational view of the device shown in FIG. 1 with portions broken away and shown in cross-section to show details of the mechanism for raising and lowering the exercise platform;

FIG. 4 is an enlarged detailed view of the resistance and speed measuring mechanism of the device shown in FIG. 1;

FIG. 5 is a vertical cross-sectional view taken along line 5—5 of FIG. 4;

FIG. 7 is a vertical cross-sectional view taken along line 7—7 of FIG. 4;

Figure 6:
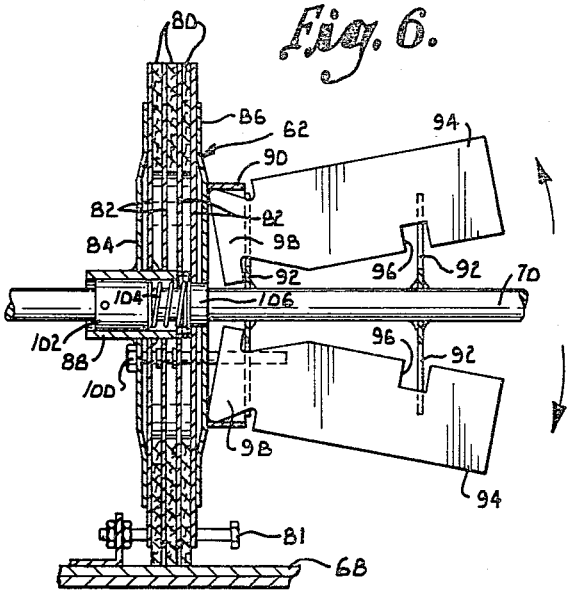
FIG. 6 is a vertical cross-sectional view taken along line 6—6 of FIG. 5.

Referring initially to FIG. 1, an exercise treadmill is designated generally by the numeral 10. Treadmill 10 comprises a continuous belt 12 which is supported by a platform 14. A height adjustment mechanism is designated generally by the numeral 16 and a rail 18 is disposed in a U-shaped configuration above belt 12.

Referring now to further details of construction of the treadmill 10, as shown in FIG. 2, platform 14 mounts a framework 20 which in turn supports a plurality of idler rollers 22 that provide a support surface for belt 12.

A larger drive roller 24 is positioned at one end of the idler rollers 22 and is coupled with a drive sprocket 26 for driving the resistance mechanism through drive chain 28. The resistance mechanism will be explained in detail hereinafter. A large end roller 30 is located at the opposite end of the row of idler rollers 22 and completes the support surface for the belt. Framework 20 which supports all of the rollers 22, 24 and 30 is mounted for pivotal movement relative to platform 14 by arms 32. In this regard, a spring 34 positioned between the end of the framework 20 and the platform resists the pivotal movement and urges the framework into its normal at-rest position.

Next, the height adjustment mechanism 16 will be described. Reference is made to FIGS. 1 through 3. Ratchet plates 36 are disposed on opposite sides of platform 14 at the front end thereof and are coupled together for unitary movement by axles 38 and 40. Axle 38 is secured to the underside of platform 14 by brackets 42 so as to accomodate pivotal movement of plates 36 relative to the platform. Each of plates 36 has a plurality of ratchet teeth 42 (FIG. 1). Axle 40 also mounts wheels 44 for moving the treadmill 10. Extending upwardly from axle 40 and secured thereto are two support rods 46 (one of which is visible in FIG. 3) which are also coupled with platform 14 at their uppermost ends. Partially surrounding each support rod 46 is a sleeve 48 which is also coupled with axle 40 and receives a coil spring 50 that surrounds the support rod.

A pawl 52 is disposed for engagement with each ratchet plate 36 and the two pawls are coupled together by a common shaft 54 mounted on the front of platform 14. A lever arm 56 is rigid with each pawl 52 to facilitate pivotal movement of the pawl out of its ratchet engaging position. In this regard, a coil spring 58 is coupled with pawls 52 and has one end secured to the platform for biasing the pawls about a pivotal axis so as to insure engagement with the ratchet teeth 42. A cover plate 60 at the front end of the platform extends over both ratchet plates 36 so as to protect a person against movement of the mechanism 16.

Referring now to FIGS. 2 and 4, treadmill 10 includes an isokinetic resistance mechanism designated generally by the numeral 62, a speed registering mechanism designated generally by the numeral 64 and a work performed recording mechanism designated generally by the numeral 66 (FIG. 2), all of which will now be described in detail.

Each of mechanisms 62, 64 and 66 are partially supported by upright framework 68 which is, in effect, an extension of platform 14. Resistance mechanism 62 comprises a shaft 70 which is rotatably mounted on framework 68. One end of shaft 70 is keyed to a sprocket 72 around which drive chain 28 is trained. A tensioning sprocket 74 is also in driving engagement with chain 28 and is pivotally mounted on arm 76 extending from framework 68. Arm 76 is biased about its pivot point by tension spring 78 which serves to keep chain 28 taut while still accomodating a limited amount of movement of framework 20.

A first frictional member surrounds shaft 70 and comprises discs 80 formed from a highly frictional material such as fiberboard or the like. Discs 80 present first frictional surfaces and are held against rotation by a retaining bolt 81 that is coupled with framework 68. A second rotatable member is formed by a series of plates 82 disposed on either side of and between discs 80. Manifestly, plates 82 present a plurality of frictional services disposed for engagement with the frictional services of discs 80. Plates 82 are sandwiched between first and second retainer discs 84 and 86. Retainer disc 84 is rigid with one of the outermost plates 82 and is also secured to a support sleeve 88. Retainer disc 86 which is rigid with the other outermost plate 82 presents a collar 90 projecting parallel to shaft 70. Shaft 70 rigidly mounts slotted guide discs 92 which carry 4 centrifugal plates 94 equally spaced around shaft 70 (FIG. 5). Each plate 94 has a notch 96 complemental to one of the guide discs 92 and an L-shaped foot 98 received by the other disc 92 and the collar 90. All three frictional discs 80 as well as the two retainer discs 84 and 86 are coupled together for unitary movement with shaft 70 by bolt assemblies 100 which extend through the discs and through one of the guide discs 92.

A fixed collar 102 on shaft 70 provides a stop for a coil spring 104 circumscribing the shaft while the other end of the spring abutts a bushing 106 that is movable with plates 82 and 86.

Mounted on shaft 70 at the opposite end from centrifugal plates 94 are first and second camming elements 108 and 110. Camming element 108 is rigid with framework 68 and shaft 70 is journaled through it. Element 108 presents a first camming surface 108*a* being generally arcuate although characterized by a flat linear section 108*b*. Camming element 110 is complemental to element 108 but is free to move relative to shaft 70 against sleeve 88. Element 110 has generally arcuate and flat surface portions corresponding to and in abutting relationship with surface portions 108*a* and 108*b*. A lever arm 112 is rigid with element 110 and is coupled with a cable 114 for operation by a trigger element 116 mounted on rail 18. A friction washer assembly 118 holds trigger 116 in a selected position.

Referring again to FIG. 4, a sheave 120 which is rigid with shaft 70 turns a belt 122 which then drives a sheave 124. Sheave 124 drives dial 126 through a cable 128 and a gear box 130. Dial 126 provides an indication of the distance traveled by movement by belt 12.

The aforementioned speed register mechanism 64 comprises a shaft 132 rotatably mounted on framework 68 and drive by belt 134 and sheaves 136 and 138 on shafts 132 and 70 respectively. A double eared bracket 140 is rigid with shaft 132 and mounts wedge-shaped weights 142. Weights 142 are pivotally coupled with bracket 140 through pins 144. A sleeve 146 is movable laterally along shaft 132 and has an actuating disc 148 positioned at one end which is also laterally movable. Sleeve 146 also carries an arm assembly 150 partially visable in FIG. 4 and partially visable in FIG. 7. Movement of sleeve 146 along the shaft is resisted by coil spring 152. A ring 153 of relatively soft material presents a bumper for receiving the ends of weights 142 on the ladder or end at rest positions.

Figure 8:
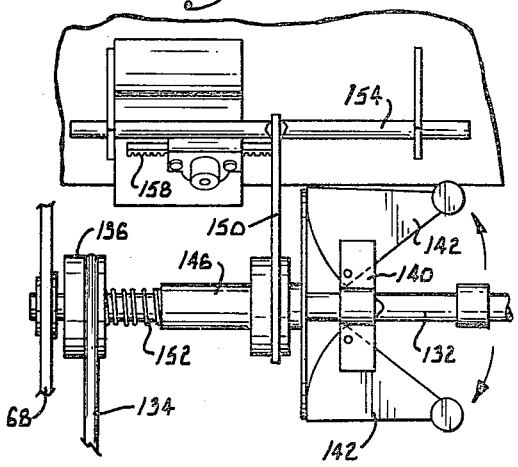
FIG. 8 is a vertical cross-sectional view taken along line 8—8 of FIG. 7.

With reference to FIG. 8, it is seen that arm 150 is rigid with a reciprocating rod 154. A drive pin 156 (FIG. 7) which is coupled with the rod drives a gear rack 158 over a rectalinear path. Gear rack 158 is meshed with a pinion gear (not shown) that is coupled with dial 160. Dial 160 provides an indication of the speed of movement of belt 12 as will be more fully described hereinafter.

Figure 9:
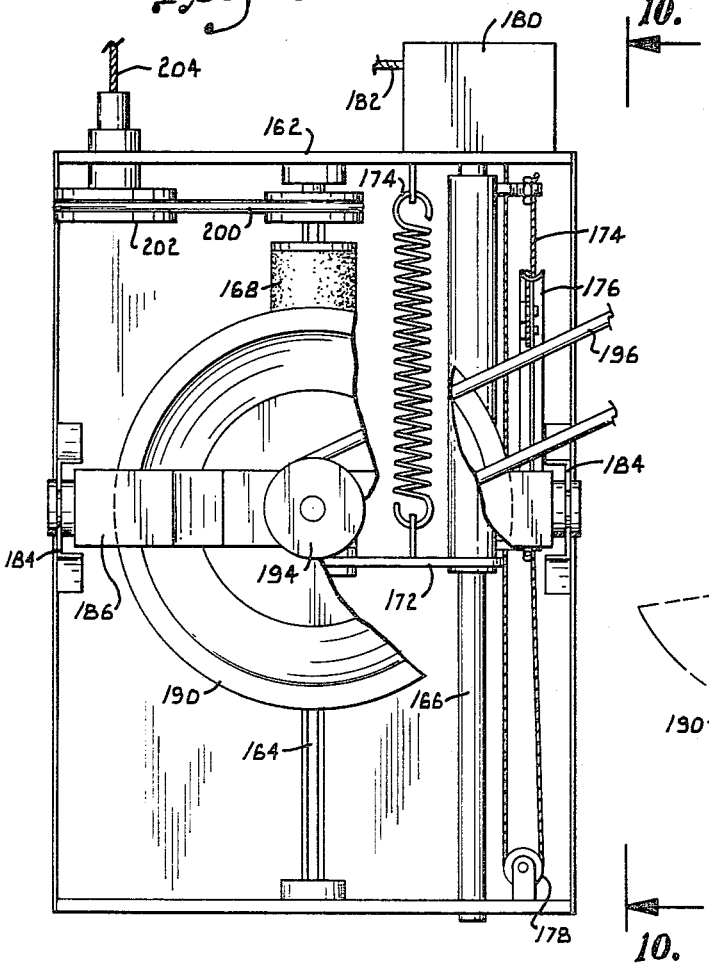
FIG. 9 is an enlarged vertical cross-sectional view taken along line 9—9 of FIG. 4.
Figure 10:
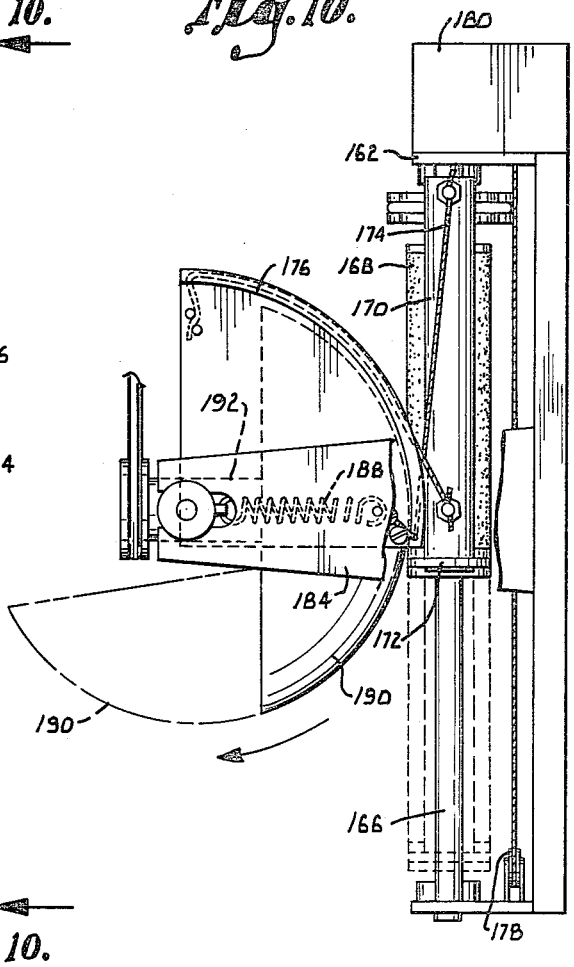
FIG. 10 is an elevational view taken in the direction of line 10—10 of FIG. 9.

The aforementioned work performed recording mechanism 66 will now be described in detail with particular reference to FIGS. 9 and 10. A framework 162 extends upwardly from platform 14 and mounts rotatable shaft 164 and stationary shaft 166. Shaft 164 mounts elongated roller 168 which is keyed to the shaft for rotation therewith while being free to move longitudinally along the length of the shaft. A sleeve 170 which is carried by shaft 166 is coupled with roller 168 through an arm 172. A tension spring 174 extends from arm 172 to the framework 162 so as to bias roller 168 toward its normal at rest position. Sleeve 170 is coupled with a cable assembly 174 which is trained over a guide plate 176 and a pulley 178 before it is coupled with gear box 180. A second cable 182 is also coupled with gear box 180 and with one of the arms 32 so as to respond to the pivotal movement of the arms and translate this movement to the gear box. Gearing 180 upgrades the movement of cable 182 so that cable 174 moves a substantially greater distance than the input cable 182.

Brackets 184 extend laterally from framework 162 and provide support for a U-arm 186 extending between the brackets. Arm 186 is received in appropriate slots in brackets 184 and is permitted a limited degree of movement in the slots while being retained by coil springs 188. A bowl shaped member 190 is disposed with its convex surface in running engagement with the surface of roller 168. Bowl member 190 is provided with a spindle 192 so as to couple the bowl with U-arm 186. Spindle 192 is also coupled with a shaft 194 so as to rotate the convex surface of the bowl about the axis of the spindle. Shaft 194 is driven by a belt 196 which is trained around a sheave 198 on shaft 70 (see FIG. 4). The output from shaft 164 is transferred via belt 200 to a shaft 202 and ultimately to a cable 204. Cable 204 turns a dial 206 (FIG. 4) to record the total work expended as will be more fully described hereinafter.

Operation of the exercise treadmill will now be described. A person exercising stands on belt 12 and then runs or walks over the belt surface. Movement of the belt turns drive roller 24 which causes rotation of shaft 70. As shaft 70 rotates the centrifugal forces acting on plates 94 will cause the free ends of the plates to move outwardly as illustrated in FIG. 6. This in turn causes the plates to bear against retainer disc 86 forcing plates 82 into frictional engagement with the disc 80. As the centrifugal forces increase, plates 94 will move farther away from shaft 70 increasing the frictional resistance between the disc and plates 82. As the exercise movement slows, the diminishing centrifugal forces acting on plates 94 together with the action of spring 104 will cause the plates to return toward shaft 70.

It is to be noted that the initial threshold resistance which must be overcome to turn shaft 70 is variable by moving trigger 116 thus causing the camming surfaces of elements 108 and 110 to move relative to each other so as to cause plates 82 to engage frictional discs 80 with varing amounts of force. This in turn controls the speed of the exercise movement by increasing the amount of resistance which must be overcome to bring about rotation of shaft 70. It has been found that a particularly effective isokinetic resistance is provided by plates 94 and the discs 80 and plates 82. Preferably, the total area of contact between the surfaces of discs 80 and plates 82 is at least 30 square inches. The plates 94 are particularly effective in providing centrifugal force responsive members since by having a plurality of plates, preferably 4, equally spaced around shaft 70 the centrifugal forces are spread over a relatively large area and the construction of the foot 98 of each plate is such that two points of contact are provided for exerting lateral forces to cause plates 82 to move against disc 80. The relatively large surface area of plates 94 also results in smooth operation at relatively high speed because the wind resistance encountered actually cushions the centrifugal forces acting on the plates. In order to provide sufficient momentum for belt 12 to continue moving between strides of a person running on it, it has been found that the belt should be disposed at an angle of at least 3° relative to the horizontal.

As shaft 70 rotates belt 122 turns cable 128 which drives gear box 130 to cause dial 126 to record the total distance traveled by a person using the treadmill.

Rotation of shaft 70 also drives belt 134 to cause rotation of the shaft 132. As shaft 132 rotates weights 142 will move outwardly in response to centrifugal forces thereby causing lateral movement of actuating disc 148. Movement of the disc effects movement of arm 150 which in turn moves gear rack 158 which drives dial 160 to provide an indication of the speed of exercise movement. Manifestly, weights 142 will pivot outwardly away from shaft 132 a greater distance as the speed of exercise movement increases thereby causing arm 150 to move farther. This movement is resisted by coil spring 152 which assists in returning weights 142 to their at rest positions as the speed of exercise movement decreases.

Rotation of shaft 70 also drives belt 196 causing bowl member 190 to rotate and drive roller 168. The total number of revolutions of roller 168, in response to turning by belt 196 is a direct function of the distance traveled by belt 12. As the person exercising on belt 12 increases the amount of force exerted, by running harder, framework 20 will pivot about arms 32 and this movement is translated to the pivotal mounting for bowl 190 to cause the bowl to pivot as indicated in the position shown in broken lines in FIG. 10. Because of the larger circumference of the bowl as it moves toward its outermost edge (as compared with its circumference nearer its center) the speed of rotation of roller 168 is increased. This increase in the amount of turning of roller 168 is a direct function of the force exerted by the exerciser. Pivotal movement of bowl 190 is resisted by the action of coil spring 174 which assists in returning the bowl to its at rest position as the force of exercise movement decreases. Bowl member 190 and roller 168 thus cooperate to integrate both force and distance readings. The total revolutions of roller 168 thus provides an indication of the total work expended and this measurement is translated through cable 204 to dial 206.

A cover panel 208 at the forward end of platform 14 covers the dials 126, 160 and 206 aforedescribed. Space is also provided for other indicators which may be incorporated into the treadmill including a thrust indicator and a cardiac pulse meter (not shown). At the opposite end of platform 14 from panel 208 a handle 210 is mounted so as to provide means for lifting one end of the treadmill and moving it on wheels 44. Another handle 212 at the forward end of the platform is utilized when adjusting the platform height. To raise the platform, handle 212 is lifted thus augmenting the forces of coil springs 50 and allowing ratchet plates 36 to move downwardly until pawls 52 engage the desired ratchet teeth 42. To lower the platform, levers 56 are depressed against the action of springs 58 thereby allowing the platform to drop the desired distance until pawls 52 again engage teeth 42.

Having thus described the invention, we claim:

1. Exercise apparatus comprising:

a rotatable shaft;

a first member presenting a first surface;

means for holding said first member against rotation with the shaft;

a second member presenting a second surface and being coupled with the shaft for rotation therewith and movable toward and away from said first surface for engagement with the latter upon rotation of the shaft;

means adapted to be acted upon by a user of the apparatus for rotating said shaft;

a plurality of generally flat plates extending longitudinally in a direction parallel to said shaft and coupled with the latter; and plate mounting means comprising first disc means journaled on said shaft, collar means mounted on said disc means and extending therefrom in the direction of said plates, the ends of said plates abutting said first disc means, and second disc means being rigid with said shaft and spaced from said first disc means, said second disc means having slots for receiving the ends of said plates and presenting a keeper ring to restrain lateral movement of said plates while accommodating pivotal movement in a direction perpendicular to the restrained lateral movement, whereby said plates pivot in response to rotation of said shaft and in proportion to the speed of rotation thereby urging said second surface toward said first surface to increase the frictional resistance between the surfaces as the speed of rotation of said shaft increases and withdrawing the plates as the speed of rotation of said shaft decreases.

2. Apparatus as set forth in claim 1, wherein is included at least four of said plates equispaced around said shaft.

3. Apparatus as set forth in claim 1, wherein is included spring means disposed around said shaft on the side of said second member opposite said plates whereby movement of said second member in response to pivotal movement of said plates is resisted by the force of said spring means.

4. An exercise device comprising:

a continuous movable belt presenting a running surface for supporting a person using said device, said belt being disposed at an angle relative to the horizontal;

a rotatable shaft coupled with said belt;

a first member presenting a first surface and being held against rotation with said shaft;

a second member presenting a second surface and being coupled with the shaft for rotation therewith while being movable toward and away from said first surface for engagement with the latter upon rotation of the shaft; and a plurality of generally flat plates extending longitudinally in a direction parallel to said shaft and coupled with the latter; and plate mounting means comprising first disc means journaled on said shaft, collar means mounted on said disc means and extending therefrom in the direction of said plates, the ends of said plates abutting said first disc means, and second disc means being rigid with said shaft and spaced from said first disc means, said second disc means having slots for receiving the ends of said plates and presenting a keeper ring to restrain lateral movement of said plates while accommodating pivotal movement in a direction perpendicular to the restrained lateral movement, whereby said plates pivot in response to rotation of said shaft and in proportion to the speed of rotation thereby urging said second surface toward said first surface to increase the frictional resistance between the surfaces as the speed of rotation of said shaft increases and withdrawing the plates as the speed of rotation of said shaft decreases.

5. The invention of claim 4, wherein said second member presents a total surface area of at least approximately thirty square inches.

6. The invention of claim 4, wherein said belt is disposed at an angle of inclination of at least 3° from the horizontal.

7. The invention of claim 4, wherein is included a plurality of support rollers for said belt; a framework for mounting said support rollers; pivotal means mounting said framework and means for registering the extent of movement of said framework in response to said person running on said belt thereby providing an indication of the force exerted by said person.

8. The invention of claim 7, wherein is included means for measuring the distance covered by a person running on said belt.

9. The invention of claim 8, wherein is included means for integrating said force registration and said distance measurement to provide an indication of the work expended by a person running on said belt.

10. Exercise apparatus comprising:

a rotatable shaft;

a first member having first and second frictional surfaces;

means for holding said first member against rotation with the shaft;

a second member coupled with the shaft and movable toward and away from said first surface for engagement with the latter upon rotation of the shaft;

a third member rotatably coupled with the shaft on the side of said first member opposite said second member and movable longitudinally of the shaft into engagement with said second surface whereby to sandwich said first member between the second and third members;

first camming means presenting an immovable sleeve around said shaft;

second camming means, complemental to said first means and presenting a movable sleeve around said shaft, pivotal movement of said second camming means resulting in lateral movement thereof away from said first camming means;

said second camming means being disposed to move said third member in the direction of said first member to cause the latter to engage said first member with a predetermined force;

means coupled with said second camming means for effecting pivotal movement of the latter and for holding said second camming means in a fixed position relative to said first camming means;

means adapted to be acted upon by the user of the apparatus for rotating said shaft; and centrifugal force responsive structure rotatably coupled with said shaft and responsive to the speed of rotation of the shaft for first moving said second member in the direction of said first member to engage the second member against the first member with greater force as the speed of rotation continues to increase, and for withdrawing the second member from the first member as the speed of rotation decreases.

11. Apparatus as set forth in claim 10, wherein said means adapted to be acted upon by a user comprises a continuous movable belt presenting a running surface for supporting a person, said belt being disposed at an angle of at least 3° relative to the horizontal.

12. Apparatus as set forth in claim 11, wherein said first and second surfaces present a combined area of at least thirty square inches.

* * * * *